US011624361B1

(12) United States Patent
Mork et al.

(10) Patent No.: US 11,624,361 B1
(45) Date of Patent: Apr. 11, 2023

(54) ANCHORED LOW PRESSURE GEAR PUMP WEAR PLATE

(71) Applicant: Caterpillar Inc., Peoria, IL (US)

(72) Inventors: David Arthur Mork, Yorkville, IL (US); Paul Richard English, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/672,906

(22) Filed: Feb. 16, 2022

(51) Int. Cl.
*F03C 2/00* (2006.01)
*F03C 4/00* (2006.01)
(Continued)

(52) U.S. Cl.
CPC ..... *F04C 2/16* (2013.01); *F04C 2/102* (2013.01); *F04C 15/0026* (2013.01); *F04C 15/0038* (2013.01); *F04C 15/0042* (2013.01); *F04C 15/0096* (2013.01); *F04C 2210/24* (2013.01); *F04C 2240/20* (2013.01); *F04C 2240/801* (2013.01); *F04C 2270/16* (2013.01); *F04C 2270/175* (2013.01)

(58) Field of Classification Search
CPC ..... F04C 2/082; F04C 2/102; F04C 2/126; F04C 2/16; F04C 15/0023; F04C 15/0026; F04C 15/0038; F04C 15/0042; F04C 15/0096; F04C 2210/24; F04C 2240/20; F04C 2240/80; F04C 2240/801; F04C 2270/16; F04C 2270/175; F01C 21/108
See application file for complete search history.

(56) References Cited

U.S. PATENT DOCUMENTS 2,134,153 A * 10/1938 Seyvertsen ..... F04C 15/0026 418/134
2,210,152 A * 8/1940 Sacha ..... F04C 15/0026 418/134
(Continued)

FOREIGN PATENT DOCUMENTS

GB 692823 A 6/1953
JP 2013024192 A * 2/2013 ..... F04C 15/06
KR 20200037609 A * 4/2020 ..... F04C 2/16

OTHER PUBLICATIONS

JP-2013024192-A—Yoshimura Seiji—Gear Pump—Feb. 4, 2013—English Machine Translation. (Year: 2013).*
(Continued)

*Primary Examiner* — Theresa Trieu
(74) *Attorney, Agent, or Firm* — von Briesen & Roper, s.c.

(57) ABSTRACT

A low pressure gear pump and wear plate is disclosed. The wear plate may comprise a sidewall, a drive portion, a driven portion, and a transition portion. The sidewall is free of a sealing member or a recess configured to receive the sealing member. The drive portion includes a drive inlet lip, a drive outlet lip, a drive recessed trough and a drive bore. The drive bore is configured to receive the drive shaft of the gear pump. The driven portion may that include a driven inlet lip, a driven outlet lip, a driven recessed trough, and a driven bore. The driven bore is configured to receive the driven shaft of the gear pump. The transition portion may include a transition aperture configured to receive a first fastener configured to mount the wear plate to the gear housing. The wear plate is made of bronze, aluminum or non-magnetic material.

20 Claims, 6 Drawing Sheets

(51) Int. Cl.

| | |
|---|---|
| ***F04C 15/00*** | (2006.01) |
| ***F04C 2/00*** | (2006.01) |
| ***F04C 2/16*** | (2006.01) |
| ***F04C 2/10*** | (2006.01) |

(56) References Cited

U.S. PATENT DOCUMENTS

| | | | | |
|---|---|---|---|---|
| 2,708,548 | A * | 5/1955 | Blanton | F04C 2/126 418/206.7 |
| 3,291,059 | A * | 12/1966 | Werrabrunoh | F04C 2/086 418/179 |
| 4,298,319 | A | 11/1981 | Glidden | |
| 4,465,444 | A | 8/1984 | Dworak et al. | |
| 9,022,761 | B2 | 5/2015 | Flavelle | |
| 2012/0242140 | A1* | 9/2012 | Koizumi | F04C 15/0023 418/131 |
| 2014/0348686 | A1 | 11/2014 | Paval et al. | |
| 2019/0128256 | A1* | 5/2019 | Enke | F04C 2/086 |
| 2020/0003208 | A1* | 1/2020 | Hosoi | F04C 15/0026 |

OTHER PUBLICATIONS

KR20200037609A—Jeong Heon Sul—Flow Control Type Fluid Pump—Apr. 9, 2020—English Machine Translation. (Year: 2020).*

* cited by examiner

ANCHORED LOW PRESSURE GEAR PUMP WEAR PLATE

TECHNICAL FIELD

The present disclosure generally relates to hydraulic gear pumps, and more particularly, to low pressure gear pumps.

BACKGROUND

Hydraulic gear pumps are made for a wide range of applications and the pressure requirements can vary from pressures as low as 5 psi to over 3000 pounds per square inch (psi). Gear pumps for high pressure applications are structurally different than those for low pressure applications because of different operating parameters. The disclosure herein is directed to hydraulic gear pumps for low pressure applications. Low pressure as used herein is pressure greater than zero and less than about 100 pounds per square inch (psi). Low pressure gear pumps are known as fixed clearance pumps. These types of gear pumps may experience adhesion or frictional rubbing/smearing on the housing from rotating gears.

U.S. Pat. No. 9,022,761, issued May 5, 2015, (the '761 Patent) describes a positive displacement gear pump. The gears have specially designed teeth at the ends of the gears' major and minor diameter axes. For example the teeth at the ends regions of the major diameter axes include radially extending wipers or vanes that extend and run against the circular gear case bore walls to seal liquid slip paths at radial running clearance areas between the tips of the gear teeth and the case bores. The pump may also have moveable floating side plates on one or both sides of the gears that may be loaded laterally to seal liquid slip paths at lateral running clearance areas between the side faces of the gears and the pump faceplate and backplate. The plates include a gasket wrapped around the radial periphery of the plates to help form the seal between the plates and the circular wall sections. A better solution is desired.

SUMMARY OF THE DISCLOSURE

In one aspect of the present disclosure, a low pressure gear pump is disclosed. The low pressure gear pump may comprise: a housing defining a chamber, a first wear plate disposed in the chamber, a drive shaft, a driven shaft, a drive gear, a driven gear and a first fastener. The chamber has an inlet, an outlet and an inner wall. The first wear plate comprises a sidewall, a drive portion, a driven portion and a transition portion. The sidewall extends from a front face to a back face and defines an outer perimeter of the wear plate. The drive portion surrounds a drive bore. The driven portion surrounds a driven bore. The transition portion is disposed between and contiguous with the drive portion and the driven portion. The transition portion includes a transition aperture. The drive shaft is rotatably disposed in the drive bore. The driven shaft is rotatably disposed in the driven bore. The drive gear is coupled to the drive shaft. The driven gear is coupled to the driven shaft and is rotatably meshed with the drive gear. The drive gear and the driven gear are disposed adjacent to the first wear plate. The first fastener mounts the first wear plate to the housing. The first fastener is disposed in the transition aperture and includes a head that is recessed from the front face. The gear pump is free of a sealing member disposed between the sidewall of the wear plate and the inner wall of the chamber. The first wear plate is made of a different material than the material of the drive gear or the driven gear.

In another aspect of the disclosure, a low pressure gear pump is disclosed. The low pressure gear pump may comprise a housing, a first wear plate, a second wear plate, a drive shaft, a driven shaft, a drive gear, a driven gear and a first plurality of fasteners. The housing may comprise a cover, an end cap and a body. The body may be disposed between the cover and the end cap. The cover, end cap and body may define a chamber having an inlet and an outlet and an inner wall. The first wear plate and the second wear plate may each comprise: a sidewall, a drive portion, a driven portion and a transition portion. The sidewall may extend from a front face to a back face and may define an outer perimeter of the wear plate. The sidewall has an inlet-facing portion and an outlet-facing portion. The inlet-facing portion may be disposed proximal to the inlet. The outlet-facing portion may be disposed proximal to the outlet. The drive portion may include: a drive inlet lip, a drive outlet lip, a drive recessed trough and a drive bore. The drive inlet lip may include a drive arcuate edge that abuts the inner wall of the chamber. The drive outlet lip may include a drive curved edge. The drive recessed trough may extend from the drive inlet lip to the drive outlet lip. The drive recessed trough may include a drive arcuate floor disposed radially inward of the drive arcuate edge and the drive curved edge. The drive bore extends through the wear plate. The driven portion may include: a driven inlet lip, a driven outlet lip, a driven recessed trough, a driven bore. The driven inlet lip may include a driven arcuate edge that abuts the inner wall. The driven outlet lip may include a driven curved edge. The driven recessed trough may extend from the driven inlet lip to the driven outlet lip. The driven recessed trough may include a driven arcuate floor. The driven bore that extends through the wear plate. The transition portion is disposed between the drive portion and the driven portion and is disposed between the inlet-facing portion of the sidewall and the outlet-facing portion of the sidewall. The transition portion includes a transition aperture that extends through the wear plate. The drive shaft is rotatably disposed in the drive bore of each of the first and second wear plates. The driven shaft is rotatably disposed in the driven bore of each of the first and second wear plates. The drive gear is disposed in the chamber and is coupled to the drive shaft. The driven gear is disposed in the chamber and is coupled to the driven shaft. The driven gear is rotatably meshed with the drive gear. The drive gear and the driven gear are sandwiched between the first and second wear plates. Each of the first plurality of fasteners is disposed in a one-to-one correspondence with the transition aperture of the first wear plate or the second wear plate. Each of the first plurality of fasteners includes a head recessed from the front face of the first wear plate or second wear plate. Each fastener of the first plurality mounts the first wear plate to the cover or the second wear plate to the end cap. The gear pump is free of a first sealing member disposed between the sidewall of the first wear plate and the inner wall and is free of a second sealing member disposed between the sidewall of the second wear plate and the inner wall. Each of the first and second wear plates is made of different material than the material of the drive gear or the driven gear.

In yet another aspect of the disclosure, a wear plate for a low pressure gear pump is disclosed. The low pressure gear pump may include a housing that defines a chamber having an inlet and an outlet, a drive gear disposed in the chamber and coupled to a drive shaft, a driven gear disposed in the chamber and coupled to a driven shaft. The wear plate may comprise: a sidewall, a drive portion, a driven portion, and a transition portion. The sidewall extends from a front face to a back face and defines an outer perimeter of the wear plate. The sidewall is free of a sealing member or a recess configured to receive the sealing member. The sidewall has an inlet-facing portion and an outlet-facing portion. The inlet-facing portion is configured to be disposed adjacent to the inlet of the chamber. The outlet-facing portion is configured to be disposed adjacent to the outlet of the gear chamber. The drive portion includes a drive inlet lip, a drive outlet lip, a drive recessed trough and a drive bore. The drive inlet lip may include an drive arcuate edge configured to receive an inner wall of the chamber. The drive outlet lip may include a drive curved edge. The drive recessed trough may extend from the drive inlet lip to the drive outlet lip. The drive recessed trough may include a drive arcuate floor that is disposed radially inward of the drive arcuate edge and the drive curved edge. The drive bore is configured to receive the drive shaft of the gear pump. The driven portion may that include: a driven inlet lip, a driven outlet lip, a driven recessed trough, and a driven bore. The driven inlet lip that may include a driven arcuate edge configured to receive an inner wall of the chamber. The driven outlet lip may include a driven curved edge. The driven recessed trough may extend from the driven inlet lip to the driven outlet lip. The driven recessed trough may include a driven arcuate floor. The driven bore is configured to receive the driven shaft of the gear pump. The transition portion is disposed between the drive portion and the driven portion and is disposed between an inlet-facing portion of the sidewall and an outlet-facing portion of the sidewall. The transition portion may include a transition aperture configured to receive a first fastener configured to mount the wear plate to the gear housing. The wear plate is made of bronze or aluminum or a non-magnetic material.

DETAILED DESCRIPTION

Figure 1:
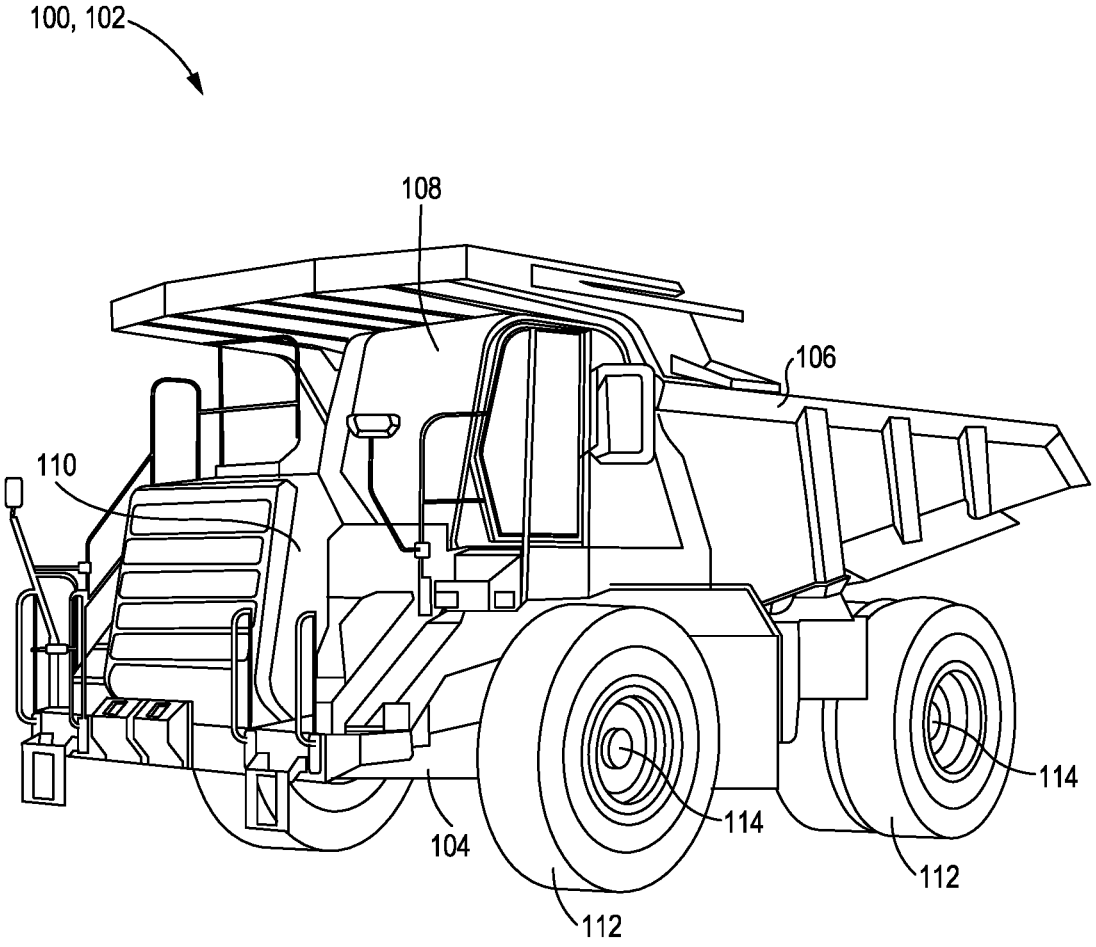
FIG. 1 is a perspective view of an exemplary machine that incorporates a low pressure gear pump according to the present disclosure.

Reference will now be made in detail to specific embodiments or features, examples of which are illustrated in the accompanying drawings. Generally, corresponding reference numbers will be used throughout the drawings to refer to the same or corresponding parts, unless otherwise specified. FIG. 1 illustrates one example of a machine 100 that incorporates the features of the present disclosure. The exemplary machine 100 may be a vehicle such as mining truck 102.

The mining truck 102 may include a frame 104. A material carrying dump body 106 may be pivotally coupled to the frame 104. Further an operator cab 108 may be mounted to the frame 104, such, e.g., above an engine enclosure 110. The mining truck 102 may be supported on the ground by a plurality of wheels 112 mounted on axles 114. A person of ordinary skill in the art will appreciate that one or more engines (not shown) or the like may be housed within the engine enclosure 110 and may provide power to the wheels 112 and a final drive assembly, via a mechanical or electric drive train. An axle and/or gear lubrication system (not shown) that includes a low pressure gear pump 116 (FIGS. 2-7) is disposed on the mining truck 102 to provide cooling and lubrication to axles (FIG. 1) and/or gears (not shown) disposed on the mining truck 102. While the following detailed description and drawings are made with reference to a mining truck 102, the teachings of this disclosure may be employed on other machines 100.

Figure 2:
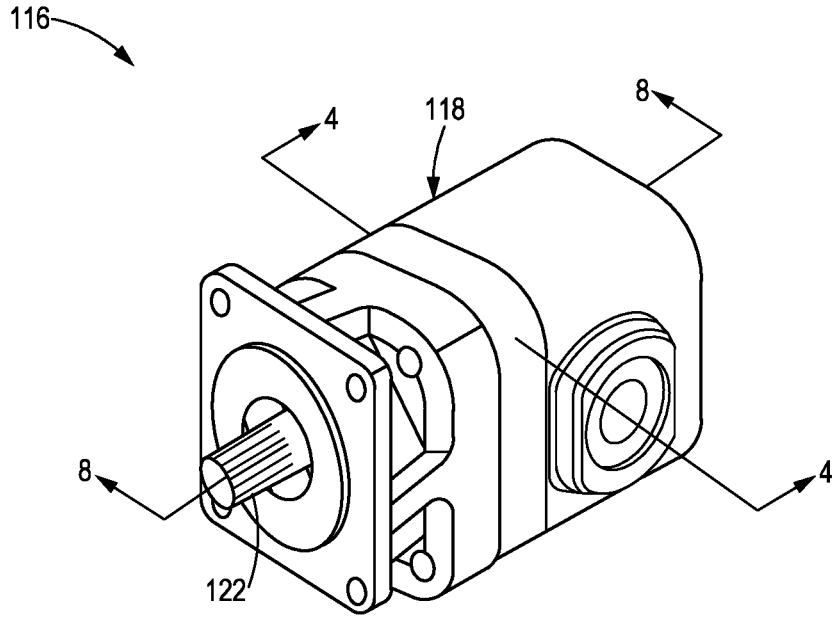
FIG. 2 is a perspective view of an exemplary low pressure gear pump, according to the present disclosure.
Figure 3:
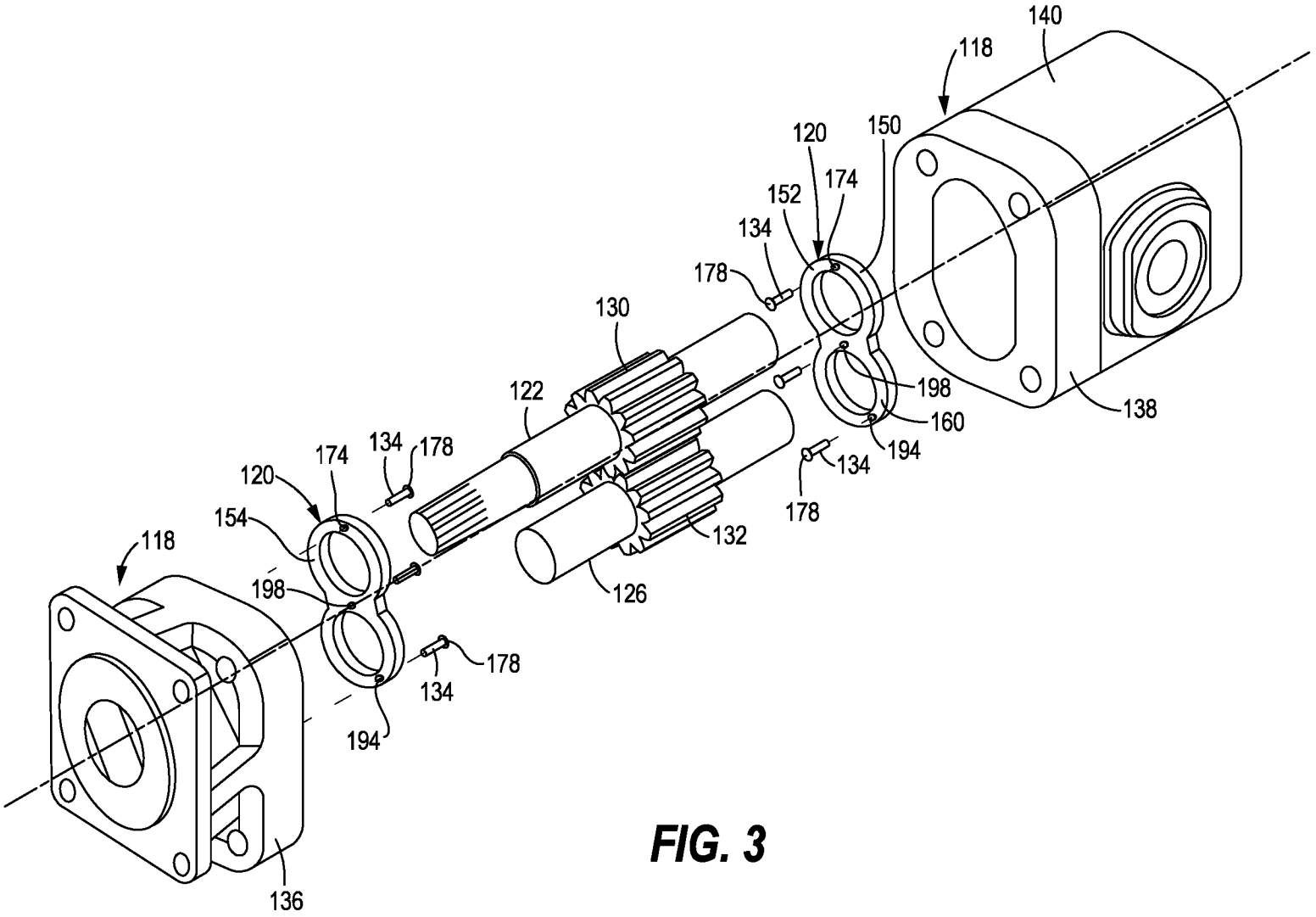
FIG. 3 is an exploded view of FIG. 2.

FIGS. 2-3 illustrate an exemplary low pressure gear pump 116. Such low pressure gear pump 116 is configured to receive fluid from a fluid source and to output fluid at a low pressure into a fluid system (not shown).

The low pressure gear pump 116 may comprise a housing 118, one or more wear plates 120 (FIG. 3), a drive shaft 122 rotatably disposed in a drive bore 124 of each of the one or more wear plates 120, a driven shaft 126 (FIGS. 3-4) rotatably disposed in a driven bore 128 (FIG. 4) of each of the one or more wear plates 120, a drive gear 130 (FIGS. 3 and 5) disposed in the housing 118 and coupled to the drive shaft 122, a driven gear 132 disposed in the housing and coupled to the driven shaft 126, and one or more fasteners 134.

The housing 118 (FIG. 3) comprises a cover 136, a body 138 and an end cap 140. The body 138 is disposed between the cover 136 and the end cap 140. The cover 136, body 138 and end cap 140 collectively define a chamber 142 that has an inlet 144 and an outlet 146. The chamber 142 includes an inner wall 148 that, in some embodiments, may be circumferential in shape (a circumferential inner wall) that extends lengthwise along the same axis that the drive shaft 122 extends lengthwise (axis E) or driven shaft 126 extends lengthwise (axis N).

Figure 6:
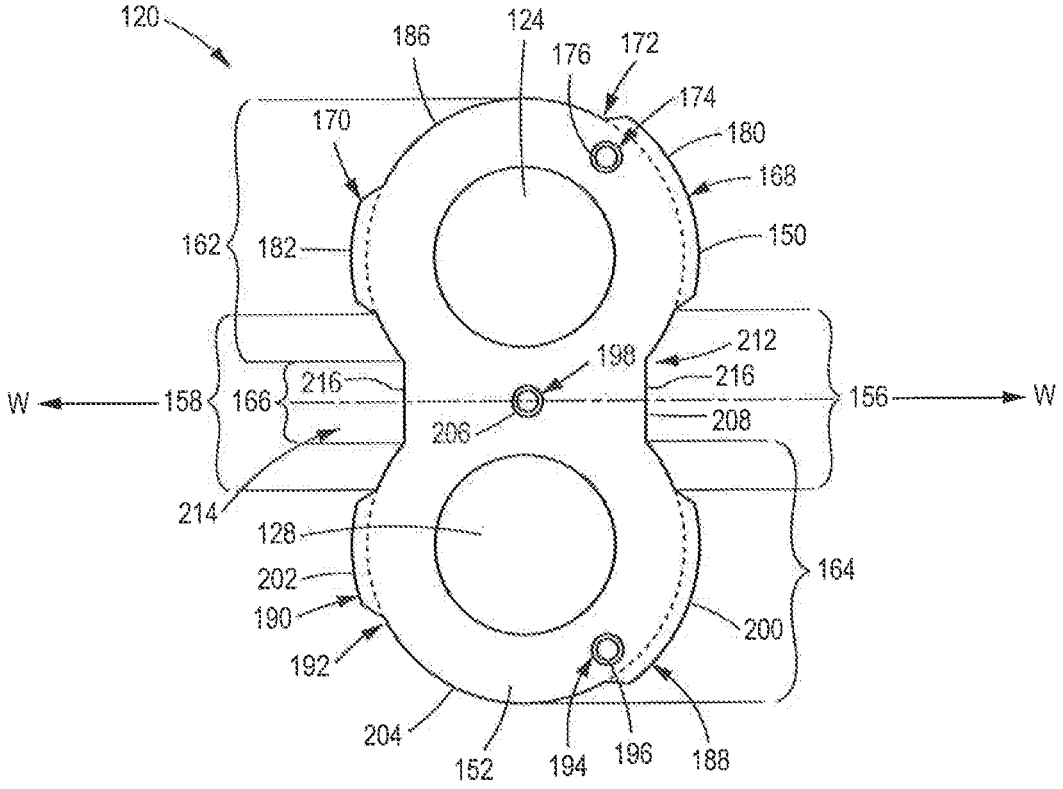
FIG. 6 is front view of an embodiment of the wear plate shown in FIG. 3.
Figure 7:
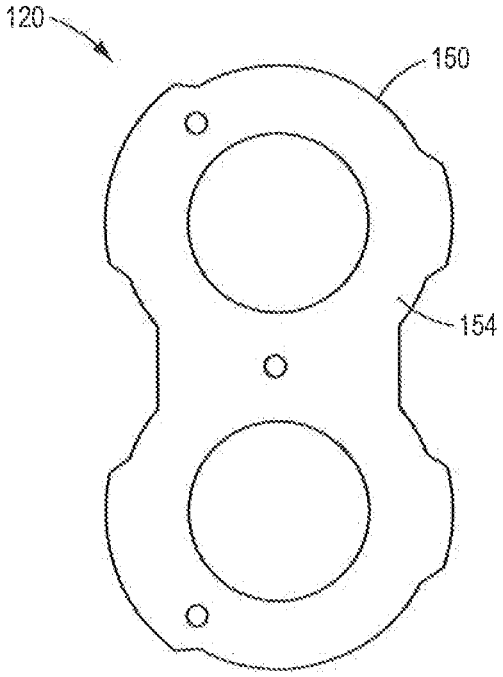
FIG. 7 is back view of the wear plate of FIG. 6.

In the embodiment shown in FIG. 3 there are two wear plates 120, namely a first wear plate 120 and a second wear plate 120. In other embodiments there may be only one wear plate 120. FIG. 6 illustrates a front view of the wear plate 120 of FIG. 3. FIG. 7 illustrates the rear view of the wear plate 120 of FIG. 6. Each wear plate 120 comprises a sidewall 150 (see also FIG. 3), a front face 152 (FIGS. 3 and 6) and a back face 154 (FIG. 7). The wear plate 120 may be generally figure-8 shaped.

Figure 4:
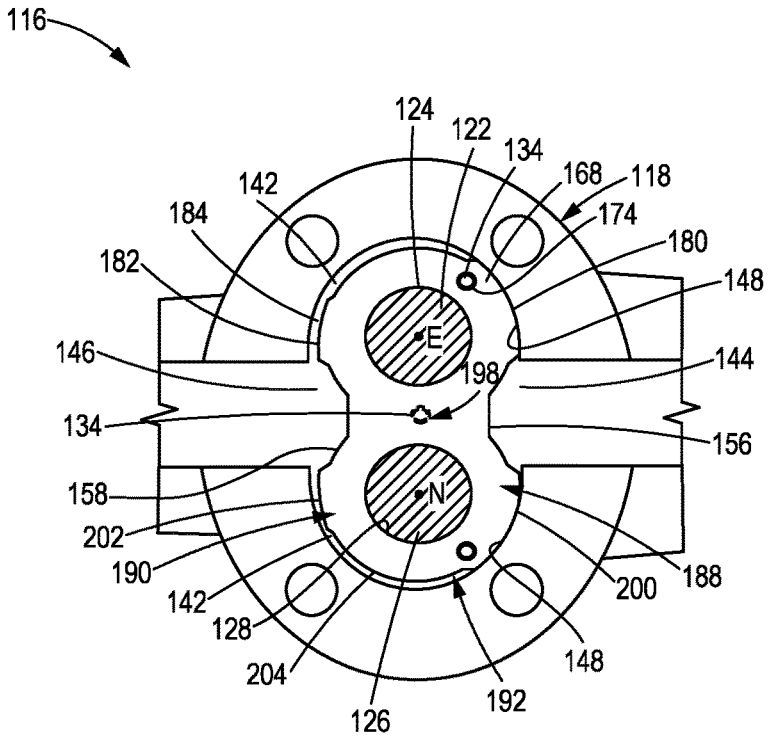
FIG. 4 is a cross sectional view of the low pressure gear pump of FIG. 2 taken along the lines of 4-4 and with the drive gear and driven gear removed.

The sidewall 150 extends from the front face 152 to the back face 154 and defines an outer perimeter of the wear plate 120. The sidewall 150 has an inlet-facing portion 156 and an outlet-facing portion 158. As shown in FIG. 4, the inlet-facing portion 156 is disposed proximal and adjacent to the inlet 144 of the chamber 142. The outlet-facing portion 158 is disposed proximal and adjacent to the outlet 146 of the chamber 142. The sidewall 150 is free of contact with a sealing member. The wear plate 120 is configured to be secured to the housing 118 without the use of a sealing member disposed directly or indirectly between the sidewall 150 and the portion of the inner wall 148 of the chamber 142 that is adjacent to the sidewall 150. The surface 160 (FIG. 3) of the sidewall 150 may be substantially smooth in texture. The inlet-facing portion 156 of the sidewall 150 forms an inlet trough 212 between the drive inlet lip 168 and the driven inlet lip 188. The inlet trough 212 is disposed adjacent to the inlet 144 of the chamber 142. The outlet-facing portion 158 forms an outlet trough 214 between the drive outlet lip 170 and the driven outlet lip 190. The outlet trough 214 is disposed adjacent to the outlet 146 of the chamber 142.

Turning to FIG. 6, the wear plate 120 further includes a drive portion 162, a driven portion 164 and a transition portion 166. The drive portion 162 includes a drive inlet lip 168, a drive outlet lip 170, a drive recessed trough 172, and a drive bore 124 that extends through the wear plate 120 and is configured to receive the drive shaft 122 (FIG. 3). The drive portion 162 (FIG. 6) may further include a drive aperture 174 disposed adjacent to the drive inlet lip 168. The drive aperture 174 is configured to receive a fastener 134 (FIG. 3) configured to mount the wear plate 120 to the housing 118. In an embodiment, the drive aperture 174 (FIG. 6) may be frustoconical in shape and may include a base 176 configured to receive a fastener head 178 (FIG. 3) of a fastener 134.

The drive inlet lip 168 (FIG. 6) includes a drive arcuate edge 180 that abuts the inner wall 148 (FIG. 4) of the chamber 142 as shown in FIG. 4. As best seen in FIG. 6, the drive inlet lip 168 may be disposed adjacent to the inlet-facing portion 156 of the sidewall 150.

The drive outlet lip 170 includes a drive curved edge 182. The drive outlet lip 170 may be disposed adjacent to the outlet-facing portion 158 of the sidewall 150. As shown in FIG. 4, the drive curved edge 182 is configured to be free (does not contact) of the inner wall 148 of the chamber 142 when the wear plate 120 is mounted on the housing 118 of the low pressure gear pump 116. In other words, there is a gap 184 between the drive curved edge 182 and the inner wall 148. In some embodiments, a perimeter of the drive curved edge 182 is less than a perimeter of the drive arcuate edge 180.

The drive recessed trough 172 (FIG. 6) extends from the drive inlet lip 168 to the drive outlet lip 170. The drive recessed trough 172 includes a drive arcuate floor 186 disposed radially inward (with a vertex on the axis E) of the drive arcuate edge 180 and the drive curved edge 182.

The driven portion 164 (FIG. 6) includes a driven inlet lip 188, a driven outlet lip 190, a driven recessed trough 192, and a driven bore 128 that extends through the wear plate 120 and is configured to receive the driven shaft 126 (FIG. 3). The driven portion 164 (FIG. 6) may further include a driven aperture 194 disposed adjacent to the driven inlet lip 188. The driven aperture 194 is configured to receive a fastener 134 (FIG. 3) configured to mount the wear plate 120 to the housing 118. In an embodiment, the driven aperture 194 (FIG. 6) may be frustoconical in shape and may include a base 196 configured to receive a fastener head 178 (FIG. 3) of a fastener 134. The driven portion 164 (FIG. 6) may be symmetric with the drive portion 162 about an axis W that is transverse to the transition portion 166 and intersects a center of a transition aperture 198.

Turning now to FIG. 4, the driven inlet lip 188 includes a driven arcuate edge that abuts the inner wall 148 of the chamber 142. The driven inlet lip 188 may be disposed adjacent to the inlet-facing portion 156 of the sidewall 150. The driven outlet lip 190 includes a driven curved edge 202. The driven outlet lip 190 may be disposed adjacent to the outlet-facing portion 158 of the sidewall 150. In some embodiments, a perimeter of the driven curved edge 202 is less than a perimeter of the driven arcuate edge 200.

The driven recessed trough 192 (FIG. 6) extends from the driven inlet lip 188 to the driven outlet lip 190. The driven recessed trough 192 includes a driven arcuate floor 204 disposed radially inward (with a vertex on the axis N) of the driven arcuate edge 200 and the driven curved edge 202.

Turning now to FIG. 6, the transition portion 166 is disposed between the drive portion 162 and the driven portion 164, and is disposed between the inlet-facing portion 156 of the sidewall 150 and the outlet-facing portion 158 of the sidewall 150. The transition portion 166 includes a transition aperture 198 that extends through the wear plate 120 and is configured to receive a fastener 134. In an embodiment, the transition aperture 198 may be frustoconical in shape and may include a base 206 configured to receive a fastener head 178. The transition portion 166 may be bounded by a pair of parallel segments 216 of the sidewall 150.

The drive shaft 122 (FIG. 3) extends along an axis E and is configured to rotate the drive gear 130. The driven shaft 126 extends along an axis N and is configured to rotate with the driven gear 132. The axis E and the axis N may be parallel.

Figure 5:
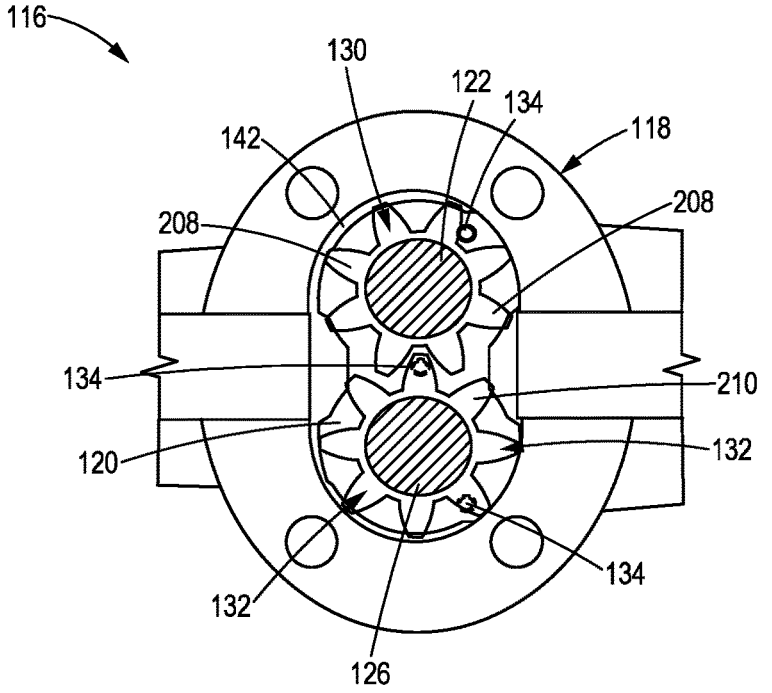
FIG. 5 is the cross sectional view of the low pressure gear pump of FIG. 4 taken with the drive gear and driven gear shown.

The drive gear 130 (FIG. 5) is disposed in the chamber 142 adjacent to one or more wear plates 120. In some embodiments, the drive gear 130 (FIG. 6) may be disposed between (sandwiched between) a first wear plate 120 and a second wear plate 120. In an embodiment, the drive gear 130 is structurally disposed directly adjacent to one or more wear plates 120. The drive gear 130 includes drive teeth 208 (FIG. 5).

The driven gear 132 is disposed in the chamber 142 adjacent to one or more wear plates 120. Similar to the drive gear 130, in some embodiments, the driven gear 132 may be disposed between (sandwiched between) the first wear plate 120 and the second wear plate 120 (FIG. 6). In an embodiment, the driven gear 132 is structurally disposed directly adjacent to one or more wear plates 120. The driven gear 132 (FIG. 5) is rotatably meshed with the drive gear 130. The driven gear 132 includes driven teeth 210. The driven teeth 210 are rotatably meshed with the drive teeth 208. In the embodiment shown in FIG. 5, the driven teeth 210 are rotatably meshed with the drive teeth 208 over the transition aperture 198. A low pressure gear pump 116 develops and outputs liquid lubricant flow by carrying such lubricant received via the inlet 144. Fluid is carried around the drive and driven gears (130, 132) in the area between the drive and driven teeth (208, 210) and the body 138 of the low pressure gear pump 116. As the drive gear 130 and driven gear 132 begin to mesh they force the liquid lubricant out the outlet 146. The drive gear 130 is driven by the drive shaft 122 and turns the driven gear 132.

A thin film of liquid lubricant present in the chamber 142 may seep or be present between the one or more wear plates 120 and the drive gear 130 and/or driven gear 132. The lubricant may comprise or be, for example, oil or other liquid that reduces friction between the one or more wear plates 120 and the drive gear 130 and/or driven gear 132 during rotation of the drive gear 130 and driven gear 132. As described herein, each of the drive gear 130/driven gear 132 is considered to be (structurally) disposed directly adjacent to a wear plate 120 regardless of whether or not a film of lubricant is present between such the wear plate 120 and the respective drive gear 130 or driven gear 132 or will form or be present during operation of the low pressure gear pump 116.

Figure 8:
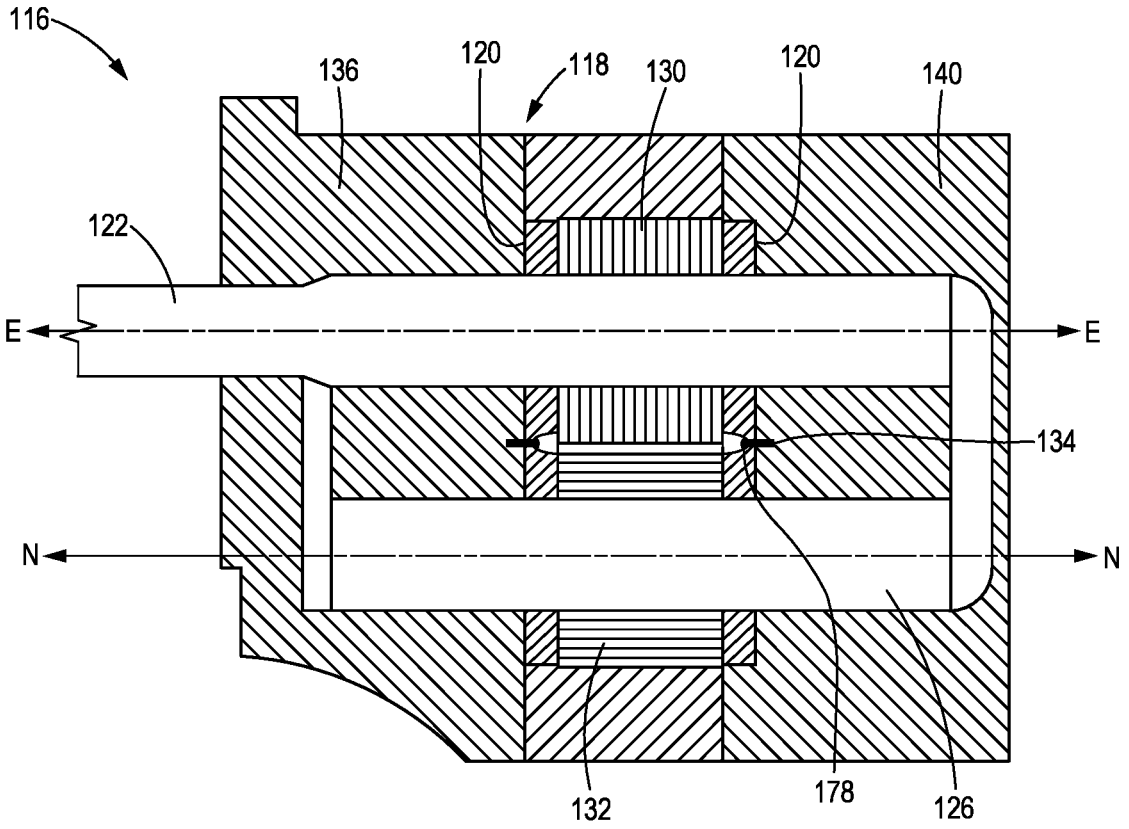
FIG. 8 is a cross sectional view of the low pressure gear pump of FIG. 2 taken along the lines of 8-8.

In the embodiment shown in FIGS. 4 and 8, a fastener 134 is disposed in the transition aperture 198 of the first wear plate 120 and is configured to mount the first wear plate 120 to the cover 136 of the housing 118, and another fastener 134 is disposed in the transition aperture 198 of the second wear plate 120 and is configured to mount the second wear plate 120 to the end cap 140 of the housing 118. Each of these fasteners 134 may include a head 178 that may be recessed from (the surface of) the front face 152 or back face 154 of the respective wear plate 120. The head of each of fastener 134 of this first plurality of fasteners 134 is disposed between the meshed drive teeth 208 and driven teeth 210 (of the drive gear 130 and driven gear 132) and the base 206 of the transition aperture 198 in which it is disposed.

As shown in FIG. 3, the exemplary embodiment of the low pressure gear pump 116 may include a fastener 134 disposed in the drive aperture 174 of the first wear plate 120 and another fastener 134 disposed in the drive aperture 174 of the second wear plate 120. Each of this second plurality of the fasteners 134 is configured to mount the respective first wear plate 120 or second wear plate 120 to the housing 118 (e.g. the cover 136 or the end cap 140). Each of these fasteners 134 may include a head 178 that is recessed from the front face 152 or back face 154 of the respective wear plate 120 and disposed against the base 176 (FIG. 6) of the drive aperture 174 in which it is disposed.

The exemplary embodiment may further include a fastener 134 (FIG. 3) disposed in the driven aperture 194 of the first wear plate 120 and another fastener 134 disposed in the driven aperture 194 of the second wear plate 120. Each of this second plurality of the fasteners 134 is configured to mount the respective first wear plate 120 or second wear plate 120 to the housing 118 (e.g., the cover 136 or the end cap 140). Each of these fasteners 134 may include a head 178 that is recessed from the front face 152 or the back face 154 of the respective wear plate 120 and disposed against the base 196 (FIG. 6) of the driven aperture 194 in which it is disposed. In some embodiments, a wear plate 120 may be free of apertures (configured to receive fasteners that mount the wear plate 120 to the housing 118) other than the transition aperture 198, the drive aperture 174 and the driven aperture 194.

The low pressure gear pump 116 is free of a sealing member (e.g., an elastomer sealing member or gasket) disposed between the sidewall 150 of the first wear plate 120 and the inner wall 148. The low pressure gear pump 116 may also be free of a sealing member disposed between the sidewall 150 of the second wear plate 120 and the inner wall 148. The first and second wear plates 120 are disposed within the chamber 142 with one or more gaps between the inner wall 148 of the chamber and the sidewall 150 of the wear plates 120 so that no seal is formed between the sidewall 150 and the inner wall 148 of the chamber 142.

Typically the drive gear 130 and/or driven gear 132 may be made of iron, steel or a magnetic metal. The first and second wear plates 120 are made of a different material than the material of the drive gear 130 or the driven gear 132. In an embodiment, the first wear plate 120 and/or second wear plate 120 may be made of bronze or aluminum or a non-magnetic metal.

INDUSTRIAL APPLICABILITY

In general, the foregoing disclosure finds utility in machines 100 that utilize low pressure gear pumps 116. More specifically, the low pressure gear pump 116 that includes one or more wear plates 120, as disclosed herein, prevents adhesive wear, does not require seals and eliminates noise while operating the low-pressure gear pump 116. Moreover, the low pressure gear pump 116 does not require a sealing member or elastomer gasket disposed on or in contact with the perimeter or sidewall 150 of the wear plate 120 to "hold" the wear plate 120 in place and/or create a pressurized volume in the chamber 142. In other words, the low pressure gear pump 116 is free of a sealing member disposed between the wear plate 120 and the inner wall 148 adjacent to the sidewall 150 of the wear plate 120. The surface 160 of the sidewall 150 of the wear plate 120 disclosed herein may have a smooth surface texture and may be free of surface grooves or the like configured to receive an elastomer sealing member. The wear plate 120 itself is secured by fasteners 134 to the housing 118.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A low pressure gear pump comprising:

a housing defining a chamber having an inlet, an outlet and an inner wall;

a first wear plate disposed in the chamber, the first wear plate comprising:

a sidewall extending from a front face to a back face, the sidewall defining an outer perimeter of the first wear plate;

a drive portion surrounding a drive bore;

a driven portion surrounding a driven bore; and a transition portion disposed between and contiguous with the drive portion and the driven portion, the transition portion including a transition aperture;

a drive shaft rotatably disposed in the drive bore;

a driven shaft rotatably disposed in the driven bore;

a drive gear coupled to the drive shaft;

a driven gear coupled to the driven shaft and rotatably meshed with the drive gear, wherein the drive gear and the driven gear are disposed adjacent to the first wear plate; and a first fastener that mounts the first wear plate to the housing, the first fastener disposed in the transition aperture and including a head that is recessed from the front face, wherein the gear pump is free of a sealing member disposed between the sidewall of the first wear plate and the inner wall of the chamber, wherein the first wear plate is made of a different material than a material of the drive gear or the driven gear.

2. The low pressure gear pump of claim 1, in which the drive portion includes:

a drive inlet lip that includes a drive arcuate edge configured to receive the inner wall of the chamber;

a drive outlet lip that includes a drive curved edge; and a drive recessed trough that extends from the drive inlet lip to the drive outlet lip, the drive recessed trough including a drive arcuate floor disposed radially inward of the drive arcuate edge and the drive curved edge.

3. The low pressure gear pump of claim 2, in which the driven portion includes:

a driven inlet lip that includes a driven arcuate edge configured to receive the inner wall of the chamber;

a driven outlet lip that includes a driven curved edge; and a driven recessed trough that extends from the driven inlet lip to the driven outlet lip, the driven recessed trough including a driven arcuate floor disposed radially inward of the driven arcuate edge and the driven curved edge.

4. The low pressure gear pump of claim 3, wherein a first section of the sidewall disposed along the drive arcuate edge and a second section of the sidewall disposed along the driven curved edge each substantially abutting the inner wall, wherein a remainder of the sidewall is free of contact with the inner wall of the chamber.

5. The low pressure gear pump of claim 1, wherein the transition aperture is frustoconical in shape.

6. The low pressure gear pump of claim 5, in which the drive gear includes drive teeth and the driven gear includes driven teeth, wherein the first fastener is disposed between the wear plate and a position where the drive teeth and driven teeth mesh together.

7. The low pressure gear pump of claim 1, wherein the first wear plate is made of bronze or aluminum or a non-magnetic metal.

8. A low pressure gear pump comprising:

a housing comprising a cover, an end cap and a body, the body disposed between the cover and the end cap, wherein the cover, the end cap and the body define a chamber having an inlet and an outlet and an inner wall;

a first wear plate and a second wear plate, each wear plate comprising:

a sidewall extending from a front face to a back face, the sidewall defining an outer perimeter of the wear plate, the sidewall having an inlet-facing portion and an outlet-facing portion, the inlet-facing portion disposed proximal to the inlet, the outlet-facing portion disposed proximal to the outlet;

a drive portion that includes:

a drive inlet lip that includes a drive arcuate edge that abuts the inner wall of the chamber;

a drive outlet lip that includes a drive curved edge;

a drive recessed trough that extends from the drive inlet lip to the drive outlet lip, the drive recessed trough including a drive arcuate floor disposed radially inward of the drive arcuate edge and the drive curved edge; and a drive bore that extends through the wear plate;

a driven portion that includes:

a driven inlet lip that includes a driven arcuate edge that abuts the inner wall;

a driven outlet lip that includes a driven curved edge;

a driven recessed trough that extends from the driven inlet lip to the driven outlet lip, the driven recessed trough including a driven arcuate floor; and a driven bore that extends through the wear plate; and a transition portion disposed between the drive portion and the driven portion, and disposed between the inlet-facing portion of the sidewall and the outlet-facing portion of the sidewall, the transition portion including a transition aperture that extends through the wear plate;

a drive shaft rotatably disposed in the drive bore of each of the first and second wear plates;

a driven shaft rotatably disposed in the driven bore of each of the first and second wear plates;

a drive gear disposed in the chamber and coupled to the drive shaft;

a driven gear disposed in the chamber and coupled to the driven shaft, the driven gear rotatably meshed with the drive gear, wherein the drive gear and the driven gear are sandwiched between the first and second wear plates; and a first plurality of fasteners, each fastener of the first plurality of fasteners disposed in a one-to-one correspondence with the transition aperture of the first wear plate or the second wear plate, each of the first plurality of fasteners including a head recessed from the front face of the first wear plate or second wear plate, each fastener of the first plurality of fasteners mounting the first wear plate to the cover or the second wear plate to the end cap, wherein the gear pump is free of a first sealing member disposed between the sidewall of the first wear plate and the inner wall and is free of a second sealing member disposed between the sidewall of the second wear plate and the inner wall, wherein the first and second wear plates is made of a different material than a material of the drive gear or the driven gear.

9. The low pressure gear pump of claim 8 in which the drive portion of each of the first and second wear plates includes a drive aperture, the low pressure gear pump further comprising a second plurality of fasteners mounting the first and second wear plates to the housing, the second plurality of fasteners disposed in a one-to-one correspondence with the drive apertures of the first wear plate and the second wear plate.

10. The low pressure gear pump of claim 9 in which the driven portion of each of the first and second wear plates includes a driven aperture, the low pressure gear pump further comprising a third plurality of fasteners mounting the first and second wear plates to the housing, the third plurality of fasteners disposed in a one-to-one correspondence with the driven apertures of the first wear plate and the second wear plate.

11. The low pressure gear pump of claim 9 wherein the first wear plate is made of bronze or aluminum or a non-magnetic metal.

12. The low pressure gear pump of claim 11 wherein the second wear plate is made of bronze or aluminum or a non-magnetic metal.

13. The low pressure gear pump of claim 9 wherein the inner wall is a circumferential inner wall that extends lengthwise in the same direction as an axis along which the drive shaft extends lengthwise.

14. A wear plate for a low pressure gear pump that includes a housing that defines a chamber having an inlet and an outlet, a drive gear disposed in the chamber and coupled to a drive shaft, a driven gear disposed in the chamber and coupled to a driven shaft, the wear plate comprising:

a sidewall extending from a front face to a back face, the sidewall defining an outer perimeter of the wear plate, the sidewall free of a sealing member or a recess configured to receive the sealing member, the sidewall having an inlet-facing portion and an outlet-facing portion, the inlet-facing portion configured to be disposed adjacent to the inlet of the chamber, the outlet-facing portion configured to be disposed adjacent to the outlet of the gear chamber;

a drive portion that includes:

a drive inlet lip that includes an drive arcuate edge configured to receive an inner wall of the chamber;

a drive outlet lip that includes a drive curved edge;

a drive recessed trough that extends from the drive inlet lip to the drive outlet lip, the drive recessed trough including a drive arcuate floor that is disposed radially inward of the drive arcuate edge and the drive curved edge; and a drive bore configured to receive the drive shaft of the gear pump;

a driven portion that includes:

a driven inlet lip that includes a driven arcuate edge configured to receive an inner wall of the chamber;

a driven outlet lip that includes a driven curved edge;

a driven recessed trough extending from the driven inlet lip to the driven outlet lip, the driven recessed trough including a driven arcuate floor; and a driven bore configured to receive the driven shaft of the gear pump; and a transition portion disposed between the drive portion and the driven portion, and disposed between an inlet-facing portion of the sidewall and an outlet-facing portion of the sidewall, the transition portion including a transition aperture configured to receive a first fastener configured to mount the wear plate to the gear housing, wherein the wear plate is made of bronze or aluminum or a non-magnetic material.

15. The wear plate of claim 14, wherein the drive inlet lip is adjacent to the inlet-facing portion of the sidewall and the drive outlet lip is adjacent to the outlet-facing portion of the sidewall.

16. The wear plate of claim 15, wherein the drive curved edge is configured to be free of the inner wall when the wear plate is mounted on the housing of the gear pump.

17. The wear plate of claim 14, in which the drive portion further includes a drive aperture disposed adjacent to the drive inlet lip, the drive aperture configured to receive a first fastener configured to mount the wear plate to the housing.

18. The wear plate of claim 14, in which the driven portion further includes a driven aperture disposed adjacent to the driven inlet lip and configured to receive a second fastener configured to mount the wear plate to the housing.

19. The wear plate of claim 14, in which the transition portion is bounded by a pair of parallel segments of the sidewall.

20. The wear plate of claim 14, wherein the wear plate is generally figure-8 shaped.

* * * * *